US010971088B2

(12) United States Patent
Wu et al.

(10) Patent No.: US 10,971,088 B2
(45) Date of Patent: Apr. 6, 2021

(54) SUB-PIXEL RENDERING METHOD AND RENDERING APPARATUS

(71) Applicant: TRULY (HUIZHOU) SMART DISPLAY LIMITED, Guangdong (CN)

(72) Inventors: Guoliang Wu, Guangdong (CN); Xiaojin Song, Guangdong (CN); Wu Zheng, Guangdong (CN); Yuewen Wang, Guangdong (CN); Tianyou Chen, Guangdong (CN); Junwen Hu, Guangdong (CN); Junhai Su, Guangdong (CN); Jianhua Li, Guangdong (CN)

(73) Assignee: TRULY (HUIZHOU) SMART DISPLAY LIMITED, Guangdong (CN)

( * ) Notice: Subject to any disclaimer, the term of this patent is extended or adjusted under 35 U.S.C. 154(b) by 288 days.

(21) Appl. No.: 15/779,846

(22) PCT Filed: Apr. 21, 2016

(86) PCT No.: PCT/CN2016/079821
§ 371 (c)(1),
(2) Date: May 29, 2018

(87) PCT Pub. No.: WO2017/092218
PCT Pub. Date: Jun. 8, 2017

(65) Prior Publication Data

US 2018/0366075 A1 Dec. 20, 2018

(30) Foreign Application Priority Data

Nov. 30, 2015 (CN) ..... 2015 1 0864198

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 2300/0452* (2013.01); *G09G 2340/0457* (2013.01); *G09G 2360/16* (2013.01)

(58) Field of Classification Search
CPC ..... G09G 3/3607; G09G 3/2003; G09G 2360/16; G09G 2340/0457; G09G 2300/0452
See application file for complete search history.

(56) References Cited

U.S. PATENT DOCUMENTS

2005/0243107 A1 11/2005 Haim et al.
2016/0035265 A1 * 2/2016 Park ..... G09G 3/2003 345/694

(Continued)

FOREIGN PATENT DOCUMENTS

CN 104036710 A 9/2014
CN 104037201 A 9/2014

(Continued)

OTHER PUBLICATIONS

Huang et al., Machine Translation of Foreign Patent Document CN 104461440 A, Rendering method, rendering device and display device, Mar. 25, 2015, pp. 1-21 (Year: 2015).*

(Continued)

*Primary Examiner* — Amr A Awad
*Assistant Examiner* — Maheen I Javed
(74) *Attorney, Agent, or Firm* — Yue (Robert) Xu; Apex Attorneys at Law, LLP

(57) ABSTRACT

A sub-pixel rendering method, comprising the following steps: acquiring a second pixel array corresponding to an (Continued)

original image, each sub-pixel of the second pixel array corresponding to a greyscale value; mapping the second pixel array of the original image onto a first pixel array; respectively finding the central positions of the sub-pixels of the first pixel array and of the second pixel array, determining sub-pixels of the second pixel array positioned in every sub-pixel preset region in the first pixel array and of the same colour as said sub-pixels in the first pixel array, and measuring the distance of same from the central position of said sub-pixels of the first pixel array; on the basis of the distance, calculating the proportional coefficient occupied by the sub-pixels of the second pixel array in the sub-pixels of the first pixel array, and on the basis of the proportional coefficient and the greyscale value of the sub-pixels of the second pixel array, calculating the greyscale value corresponding to each sub-pixel of the first pixel array. The preset sub-pixel rendering method is simple and easy to implement; few hardware resources are required, and software operation is rapid.

14 Claims, 15 Drawing Sheets

(56) References Cited

U.S. PATENT DOCUMENTS

| | | | | |
|---|---|---|---|---|
| 2016/0055780 | A1 | 2/2016 | Guo et al. | |
| 2017/0270870 | A1* | 9/2017 | Guo | G09G 3/3275 |

FOREIGN PATENT DOCUMENTS

| | | | | |
|---|---|---|---|---|
| CN | 104461440 | A | * | 3/2015 |
| CN | 104461440 | A | | 3/2015 |
| CN | 105096806 | A | | 11/2015 |
| CN | 105489177 | A | | 4/2016 |
| TW | 201533718 | A | * | 9/2015 |

OTHER PUBLICATIONS

Su et al., Machine Translation of Foreign Patent Document TW 201533718 A, Driving method of display, Sep. 1, 2015, pp. 1-20 (Year: 2015).*

International Search Report for PCT/CN2016/079821, dated Aug. 17, 2016, ISA/CN.

* cited by examiner

SUB-PIXEL RENDERING METHOD AND RENDERING APPARATUS

This application is a National phase application of PCT international patent application PCT/CN2016/079821, filed on Apr. 21, 2016 which claims priority to Chinese Patent Application No. 201510864198.2, titled "SUB-PIXEL RENDERING METHOD AND RENDERING APPARATUS", filed with the Chinese Patent Office on Nov. 30, 2015, both of which are incorporated herein by reference in their entireties.

FIELD

The disclosure relates to the field of liquid crystal display, and particularly to a sub-pixel rendering method and a rendering device.

BACKGROUND

Regarding a conventional RGB pixel arrangement, three sub-pixels of red, green and blue constitute one pixel for restoring true colors. Moreover, a higher resolution can generate a better and more vivid display effect. Practically, the present process capability is unable to satisfy the increasingly high requirement for a resolution proposed in the market, and a sub-pixel with a smaller size cannot be fabricated. In other words, only a display panel with a low resolution can be fabricated, corresponding to a new pixel arrangement. In order to achieve a display effect of a high-resolution panel, a sub-pixel rendering method is required.

A new pixel arrangement necessarily requires a sub-pixel rendering method. The sub-pixel rendering method is applied to calculate data of the conventional RGB pixel arrangement and process the data into data of a new pixel arrangement.

Therefore, how to provide a sub-pixel rendering method for improving a display effect of a display device is a technical problem to be solved.

SUMMARY

In view of this, it is necessary to provide a sub-pixel rendering method and a rendering device, to improve a display effect of a display device. The sub-pixel rendering method is simple and easy to implement.

A sub-pixel rendering method for a display device is provided. The display device includes a first pixel array, the first pixel array includes multiple first pixels and each of the first pixels includes multiple sub-pixels, and the method includes:

acquiring a second pixel array of an original image, where each of sub-pixels of the second pixel array has a grayscale value;

mapping the second pixel array of the original image onto the first pixel array;

searching for central positions of the sub-pixels of the first pixel array and of the second pixel array, determining a sub-pixel of the second pixel array which is located in a predetermined region of each sub-pixel in the first pixel array and has a same color as that of the sub-pixel in the first pixel array, and measuring a distance from the determined sub-pixel to the central position of the sub-pixel in the first pixel array; and calculating, on the basis of the distance, a ratio of the sub-pixels of the second pixel array to the sub-pixels of the first pixel array, and calculating, on the basis of the grayscale values of the sub-pixels of the second pixel array and the ratio, grayscale values of all sub-pixels of the first pixel array.

In an embodiment, the predetermined region is a region of 3*3 or 1*3 arranged around each sub-pixel of the first pixel array.

In an embodiment, the ratio of the sub-pixels of the second pixel array to the sub-pixels of the first pixel array is calculated according to an equation:

$$\text{coefficient}_{R_xC_y}=(1/r_{R_xC_y}^{N})/(\Sigma(1/r_{R_xC_y}^{N}));$$

in which, $\text{coefficient}_{R_xC_y}$ represents a ratio of the sub-pixels of the second pixel array to the sub-pixels in the $x^{th}$ row and the $y^{th}$ column of the first pixel array;

$r_{R_xC_y}$ represents a distance from the sub-pixel in the second pixel array to the sub-pixel in the $x^{th}$ row and the $y^{th}$ column of the first pixel array; and N is a constant.

In an embodiment, $1 \leq N < 3$.

In an embodiment, a grayscale value of each sub-pixel in the first pixel array is calculated according to an equation:

$$Vout(R_xC_y)=\text{coefficient}_{Rx-1Cy-1}*Vin(R_{x-1}C_{y-1})+\text{coefficient}_{Rx-1Cy}*Vin(R_{x-1}C_y)+\text{coefficient}_{Rx-1Cy+1}*Vin(R_{x-1}C_{y+1})+\text{coefficient}_{RxCy-1}*Vin(R_xC_{y-1})+\text{coefficient}_{RxCy}*Vin(R_xC_y)+\text{coefficient}_{RxCy}+1*Vin(R_xC_{y+1})+\text{coefficient}_{Rx+1Cy-1}*Vin(_{Rx+1Cy-1})+\text{coefficient}_{Rx+1Cy}*Vin(R_{x+1}C_y)+\text{coefficient}_{Rx+1Cy+1}*Vin(R_{x+1}C_{y+1});$$

in which, Vout represents a grayscale value of a sub-pixel in the first pixel array;

Vin represents a grayscale value of a sub-pixel in the second pixel array;

coefficient represents the ratio;

r represents a distance from the central position of the sub-pixel of the first pixel array to the central position of the sub-pixel of the second pixel array;

$R_x$ represents the $x^{th}$ row; and $C_y$ represents the $y^{th}$ column.

In an embodiment, the first pixel array includes pixel groups arranged in a first direction, each of the pixel groups includes multiple pixels arranged in a second direction, and each of the pixels includes red and green sub-pixels, or green and red sub-pixels, or blue and green sub-pixels, or green or blue sub-pixels, or red and blue sub-pixels, or includes blue and red sub-pixels, arranged in the second direction.

In an embodiment, two adjacent sub-pixels arranged in the second direction in the first pixel array have different colors.

In an embodiment, the first direction is a vertical direction and the second direction is a horizontal direction.

A rendering device for a display device is provided. The display device includes a first pixel array, the first pixel array includes multiple first pixels, each of the first pixels includes multiple sub-pixels, and the rendering device is configured to implement the sub-pixel rendering method described above. The rendering device includes: a recognition module, a mapping module, a measuring module and a calculating module;

the recognition module is configured to acquire a second pixel array of an original image, where each of sub-pixels of the second pixel array has a grayscale value;

the mapping module is configured to map the second pixel array of the original image onto the first pixel array;

the measuring module is configured to search for central positions of the sub-pixels of the first pixel array and the second pixel array, determine a sub-pixel of the second pixel array which is located in a predetermined region of each sub-pixel in the first pixel array and has a same color as that of the sub-pixel in the first pixel array, and measure a distance from the determined sub-pixel to the central position of the sub-pixel in the first pixel array; and the calculating module is configured to calculate, on the basis of the distance, a ratio of the sub-pixels of the second pixel array to the sub-pixels of the first pixel array, and calculate, on the basis of the grayscale value of the sub-pixels of the second pixel array and the ratio, grayscale values of all sub-pixels of the first pixel array.

With the sub-pixel rendering method mentioned above, the pixel array of the original image and the pixel array of the display device are processed, and contribution of all sub-pixels of the original image located in the predetermined region around sub-pixels in the display device to the sub-pixels in the display device is considered, such that a high-resolution display effect is achieved by a low-resolution display device. Moreover, the sub-pixel rendering method is simple and easy to implement, requires a few hardware resources, and software operates quickly.

DETAILED DESCRIPTION OF THE EMBODIMENTS

Figure 1:
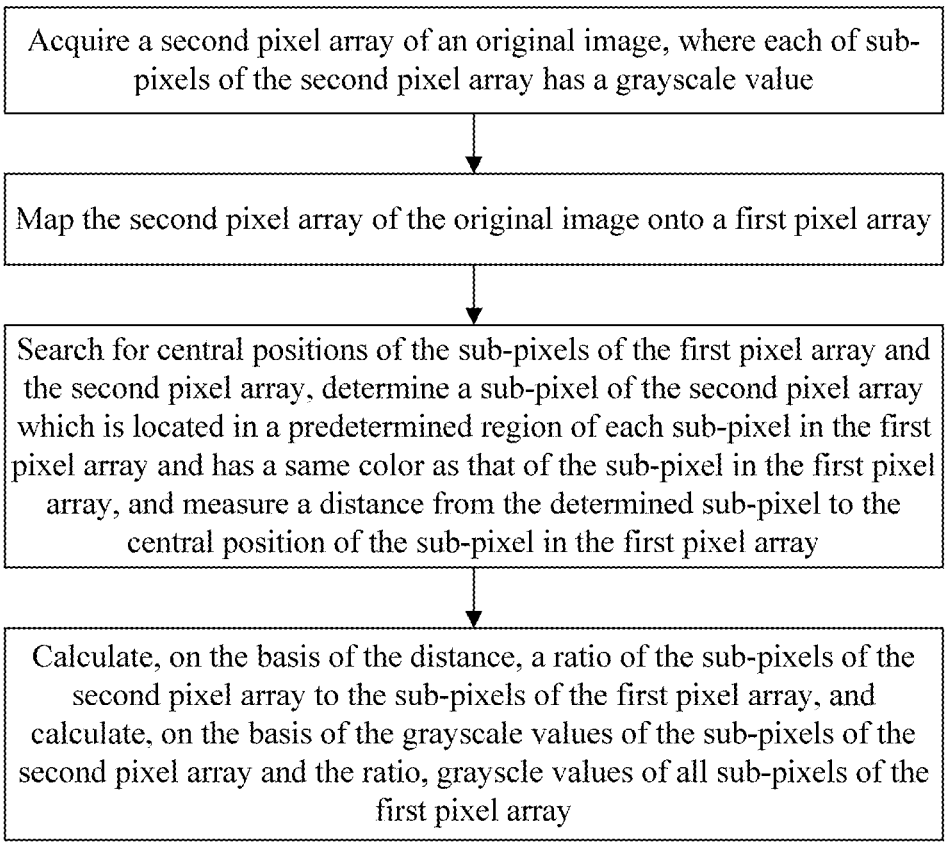
FIG. 1 is a schematic flowchart of a selection method for pixel arrangement according to an embodiment of the present disclosure.

In order to facilitate understanding the present disclosure, the present disclosure is described more comprehensively with reference to relevant drawings hereinafter. Preferred embodiments of the present disclosure are shown in the drawings. However, the present disclosure may be implemented in many different ways, and is not limited to embodiments described herein. Conversely, the embodiments are provided to gain more thorough and comprehensive understanding on the present disclosure.

Unless otherwise stated, all technical and scientific terms used herein have the same meanings as those commonly comprehended by persons skilled in the art. Terms in the specification of the present disclosure are only used to describe a particular embodiment, and are not intended to limit the present disclosure. A term "and/or" used herein includes all arbitrary combinations of one or multiple relevant items listed.

Reference is made to FIG. 1, which is a schematic flowchart of a sub-pixel rendering method according to an embodiment of the present disclosure.

A sub-pixel rendering method for a display device is provided. The display device includes a first pixel array, the first pixel array includes multiple first pixels, and each of the first pixels includes multiple sub-pixels. The method includes step S110 to step S140.

In step 110, a second pixel array of an original image is acquired. Each of sub-pixels of the second pixel array has a grayscale value.

In step 120, the second pixel array of the original image is mapped onto the first pixel array.

In step 130, central positions of the sub-pixels of the first pixel array and the second pixel array are searched for, a sub-pixel of the second pixel array which is located in a predetermined region of each sub-pixel in the first pixel array and has the same color as that of the sub-pixel in the first pixel array is determined, and a distance from the determined sub-pixel to the central position of the sub-pixel in the first pixel array is measured.

In step 140, a ratio of the sub-pixels of the second pixel array to the sub-pixels of the first pixel array is calculated on the basis of the distance, and grayscale values of all sub-pixels of the first pixel array are calculated on the basis of the grayscale values of the sub-pixels of the second pixel array and the ratio. The grayscale values of all sub-pixels of the first pixel array are calculated, to control an image displayed on the display device.

For example, the ratio of the sub-pixels of the second pixel array to the sub-pixels of the first pixel array is calculated according to an equation:

$$\text{coefficient}_{R_xC_y}=(1/r_{R_xC_y}{}^N)/(\Sigma(1/r_{R_xC_y}{}^N))$$

in which, $\text{coefficient}_{R_xC_y}$ represents the ratio of the sub-pixels of the second pixel array to the sub-pixels in the $x^{th}$ row and the $y^{th}$ column of the first pixel array;

$r_{R_xC_y}$ represents a distance from the sub-pixel in the second pixel array to the sub-pixel in the $x^{th}$ row and the $y^{th}$ column of the first pixel array; and N is a constant.

Particularly, $1 \leq N < 3$, such as N=1.2, N=1.6, or N=2. That is, values of N are determined based on actual cases. Specifically, the value of N may be selected according to experiments or experience.

In an embodiment, grayscale values of all sub-pixels in the first pixel array are calculated according to an equation:

$$Vout(R_xC_y)=\text{coefficient}_{Rx-1Cy-1}*Vin(R_{x-1}C_{y-1})+\text{coefficient}_{Rx-1Cy}*Vin(R_{x-1}C_y)+\text{coefficient}_{Rx-1Cy+1}*Vin(R_{x-1}C_{y+1})+\text{coefficient}_{RxCy-1}*Vin(R_xC_{y-1})+\text{coefficient}_{RxCy}*Vin(R_xC_y)+\text{coefficient}_{RxCy}+1*Vin(R_xC_{y+1})+\text{coefficient}_{Rx+1Cy-1}*Vin(_{Rx+1Cy-1})+\text{coefficient}_{Rx+1Cy}*Vin(R_{x+1}C_y)+\text{coefficient}_{Rx+1Cy+1}*Vin(R_{x+1}C_{y+1});$$

in which, Vout represents a grayscale value of a sub-pixel in the first pixel array;

Vin represents a grayscale value of a sub-pixel in the second pixel array;

coefficient represents the ratio;

r represents a distance from the central position of the sub-pixel of the first pixel array to the central position of the sub-pixel of the second pixel array;

$R_x$ represents a row number; and $C_y$ represents a column number.

Furthermore, the first pixel array includes pixel groups arranged in a first direction, each of the pixel groups includes multiple pixels arranged in a second direction, and each of the pixels includes red and green sub-pixels, or green and red sub-pixels, or blue and green sub-pixels, or green or blue sub-pixels, or red and blue sub-pixels, or blue and red sub-pixels, arranged in the second direction. In the first pixel array, two adjacent sub-pixels arranged in the second direction have different colors. The first direction is a vertical direction, and the second direction is horizontal direction. Sub-pixels in the first pixel array have the same size and shape.

In an embodiment of the present disclosure, the predetermined region is a region of 3*3 or 1*3 arranged around each sub-pixel of the first pixel array. Contribution of sub-pixels of the second pixel array located in the region of 3*3 or 1*3 around the sub-pixel in the first pixel array to sub-pixels of the first pixel array is taken into account, to achieve an effect of the second pixel array by the first pixel array, that is, to achieve an effect of high-resolution pixel arrangement by means of low-resolution pixel arrangement.

With the sub-pixel rendering method mentioned above, the pixel array of the original image and the pixel array of the display device are processed, and contribution made by all sub-pixels of the original image located in the predetermined region around sub-pixels of the display device to the sub-pixels of the display device is considered, such that a high-resolution display effect can be achieved by the low-resolution display device. In addition, the sub-pixel rendering method is simply and easy to implement, requires a few hardware resources, and software operates quickly.

The present disclosure is further described below in conjunction with the embodiments. It should be understood that the embodiments are illustrative, and are not intended to limit the scope of the present disclosure.

First Embodiment

A display device includes a first pixel array. The first pixel array includes multiple pixel groups arranged in a first direction, each of the pixel groups includes multiple pixels arranged in a second direction, and each of the pixels includes blue and green sub-pixels, or red and green sub-pixels, arranged in the second direction. Particularly, referring to FIG. 2, the first pixel array is Pentile.

Figure 3:
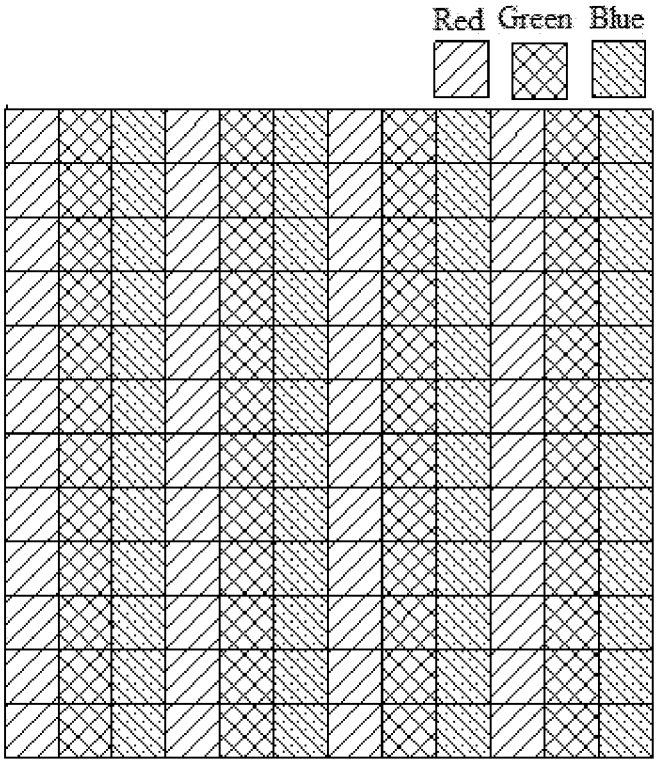
FIG. 3 is a schematic structural diagram of a second pixel array according to an embodiment of the present disclosure.

A second pixel array of the original image is acquired, in which each of sub-pixels of the second pixel array has a grayscale value. Referring to FIG. 3, the second pixel array of the original image has a RGB stripe pixel arrangement.

Figure 2:
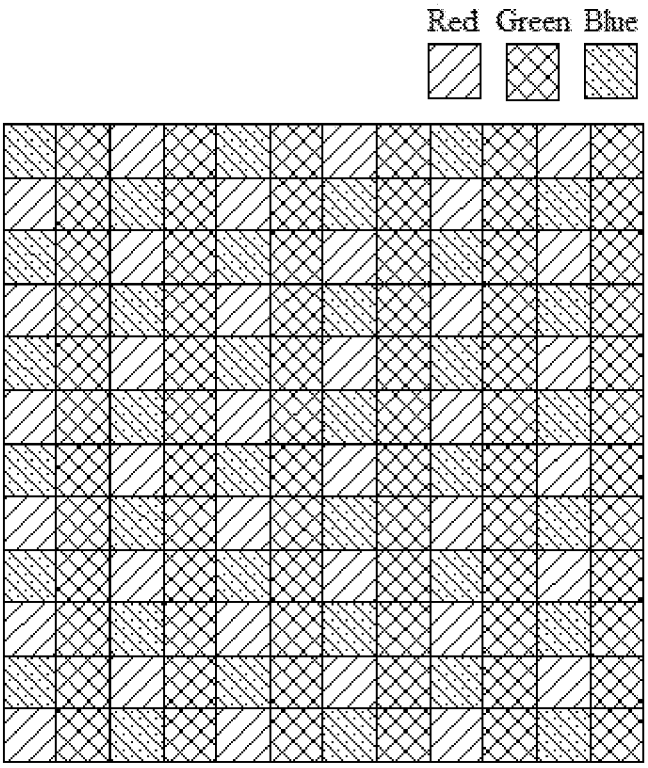
FIG. 2 is a schematic structural diagram of a first pixel array according to an embodiment of the present disclosure.
Figure 4:
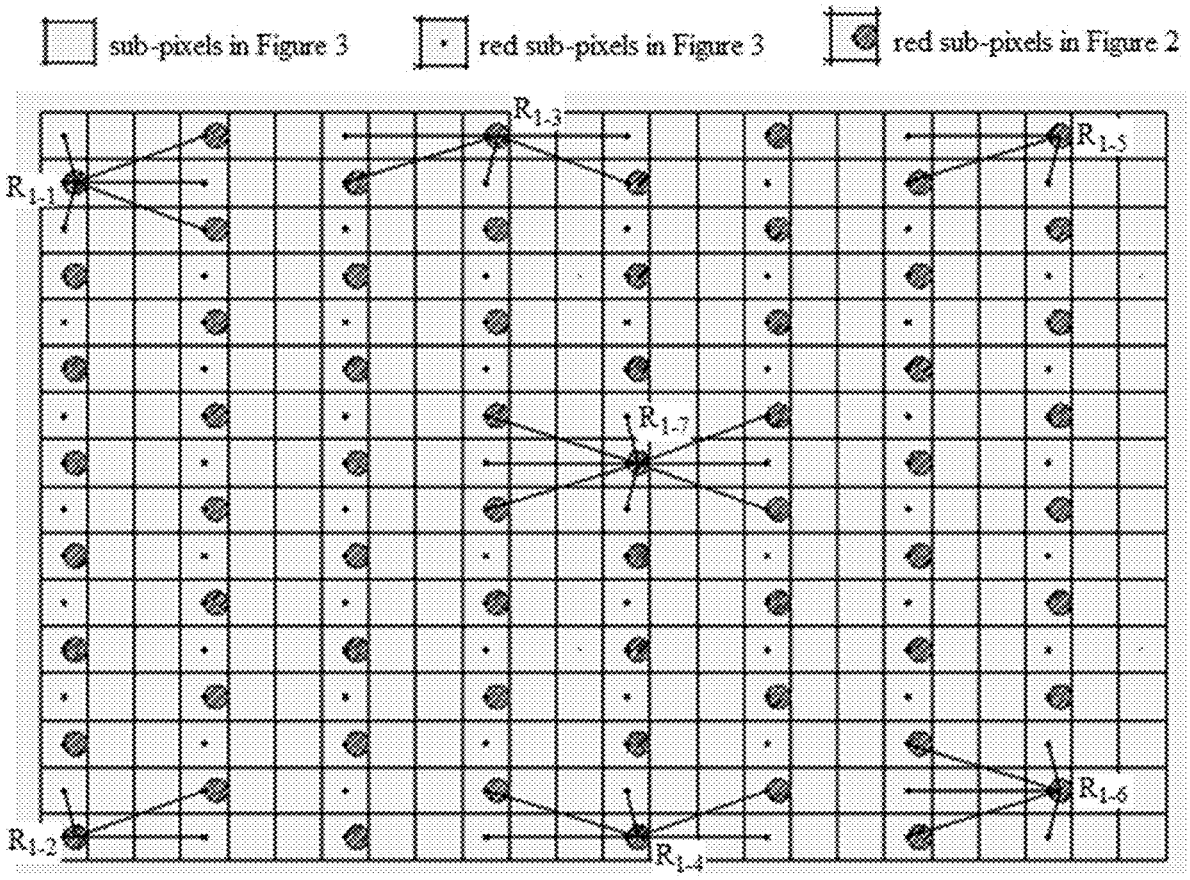
FIG. 4 is a diagram showing overlapping of central positions of red sub-pixels in FIGS. 2 and 3.

Reference is made to FIG. 4, which shows overlapping of central positions of red sub-pixels in FIGS. 2 and 3. A distance from a red sub-pixel in the first pixel array to a red sub-pixel in the second pixel array located in a region of 3*3 or 1*3 around the red sub-pixel in the first pixel array is measured. In a case of N=2, it may be obtained that $$\text{coefficient}_{R_xC_y}=(1/r_{R_xC_y}^2)/(\Sigma(1/r_{R_xC_y}^2)).$$

Grayscale values of all red sub-pixels in the first pixel array are calculated. It can be seen according to FIG. 4 that there are seven situations in total, namely, $R_{1-1}$, $R_{1-2}$, $R_{1-3}$, $R_{1-4}$, $R_{1-5}$, $R_{1-6}$ and $R_{1-7}$.

A calculation formula for the grayscale value of $R_{1-1}$ is, $$Vout(R_xC_1)=0.0516*Vin(R_{x-1}C_1)+0.0064*Vin(R_{x-1}C_2)+0.8768*Vin(R_xC_1)+0.0072*Vin(R_xC_2)+0.0516*Vin(R_{x+1}C_1)+0.0064*Vin(R_{x+1}C_2);$$

a calculation formula for the grayscale value of $R_{1-2}$ is, $$Vout(R_xC_1)=0.0548*Vin(R_{x-1}C_1)+0.0068*Vin(R_{x-1}C_2)+0.9308*Vin(R_xC_1)+0.0077*Vin(R_xC_2);$$

a calculation formula for the grayscale value of $R_{1-3}$ is, $$Vout(R_1C_y)=0.0055*Vin(R_1C_{y-1})+0.9211*Vin(R_1C_y)+0.0076*Vin(R_1C_y+1)+0.0050*Vin(R_2C_{y-1})+0.0542*Vin(R_2C_y)+0.0067*Vin(R_2C_{y+1});$$

a calculation formula for the grayscale value of $R_{1-4}$ is, $$Vout(R_xC_y)=0.0050*Vin(R_{x-1}C_{y-1})+0.0542*Vin(R_{x-1}C_y)+0.0067*Vin(R_{x-1}C_{y+1})+0.0055*Vin(R_xC_{y-1})+0.9211*Vin(R_xC_y)+0.0076*Vin(R_xC_y+1);$$

a calculation formula for the grayscale value of $R_{1-5}$ is, $$Vout(R_1C_y)=0.0055*Vin(R_1C_{y-1})+0.9313*Vin(R_1C_y)+0.0050*Vin(R_2C_{y-1})+0.0582*Vin(R_2C_y);$$

a calculation formula for the grayscale value of $R_{1-6}$ is, $$Vout(R_xC_y)=0.0048*Vin(R_{x-1}C_{y-1})+0.0519*Vin(R_{x-1}C_y)+0.0052*Vin(R_xC_{y-1})+0.8815*Vin(_{RxCy})+0.0048*Vin(R_{x+1}C_{y-1})+0.0519*Vin(R_{x+1}C_y);$$

a calculation formula for the grayscale value of $R_{1-7}$ is, $$Vout(R_xC_y)=0.0047*Vin(R_{x-1}C_{y-1})+0.0508*Vin(R_{x-1}C_y)+0.0063*Vin(R_{x-1}C_{y+1})+0.0051*Vin(R_xC_{y-1})+0.8641*Vin(R_xC_y)+0.0071*Vin(R_xC_{y+1})+0.0047*Vin(R_{x+1}C_{y-1})+0.0508*Vin(R_{x+1}C_y)+0.0063*Vin(R_{x+1}C_{y+1});$$

Figure 5:
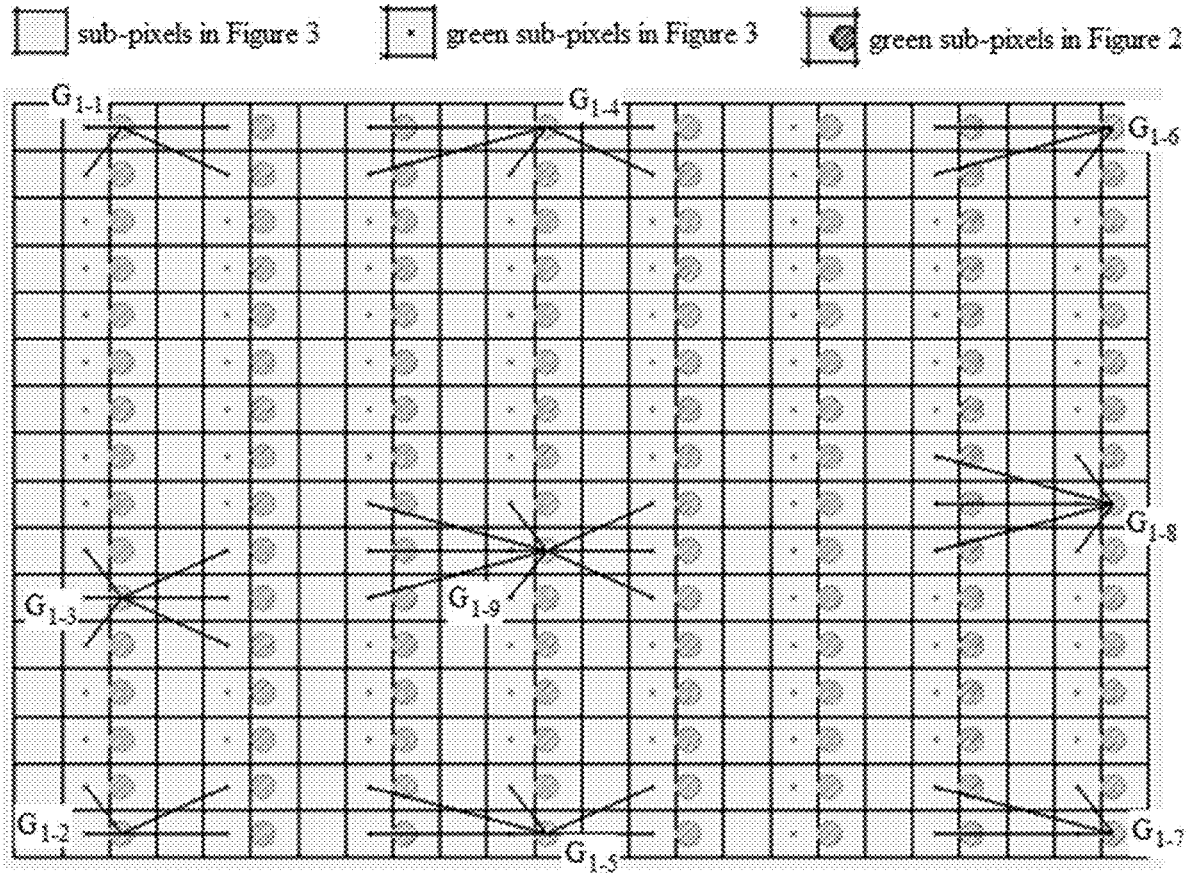
FIG. 5 is a diagram showing overlapping of central positions of green sub-pixels in FIGS. 2 and 3.

Referebce is made to FIG. 5, which shows overlapping of central positions of green sub-pixels shown in FIGS. 2 and 3 A distance from a green sub-pixel in the first pixel array to a red sub-pixel in the second pixel array located in a region of 3*3 or 1*3 around the green sub-pixel in the first pixel array is measured. In a case of N=2, $$\text{coefficient}_{R_xC_y}=(1/r_{R_xC_y}^2)/(\Sigma(1/r_{R_xC_y}^2)).$$

Grayscale values of all green sub-pixels in the first pixel array are calculated. It can be seen according to FIG. 5 that there are 9 situations in total, namely, $G_{1-1}$, $G_{1-2}$, $G_{1-3}$, $G_{1-4}$, $G_{1-5}$, $G_{1-6}$, $G_{1-7}$, $G_{1-8}$ and $G_{1-9}$.

A calculation formula for the grayscale value of $G_{1-1}$ is, $$Vout(R_1C_1)=0.6394*Vin(R_1C_1)+0.0710*Vin(R_1C_2)+0.2302*Vin(R_2C_1)+0.0593*Vin(R_2C_2);$$

a calculation formula for the grayscale value of $G_{1-2}$ is, $$Vout(R_xC_1)=0.2505*Vin(R_{x-1}C_1)+0.0646*Vin(R_{x-1}C_2)+0.6957*Vin(R_xC_1)+0.0773*Vin(R_xC_2);$$

a calculation formula for the grayscale value of $G_{1-3}$ is, $$Vout(R_xC_1)=0.1785*Vin(R_{x-1}C_1)+0.0460*Vin(R_{x-1}C_2)+0.4959*Vin(R_xC_1)+0.0551*Vin(R_xC_2)+0.1785*Vin(R_{x+1}C_1)+0.0460*Vin(R_{x+1}C_2);$$

a calculation formula for the grayscale value of $G_{1-4}$ is, $$Vout(R_1C_y)=0.0244*Vin(R_1C_{y-1})+0.6093*Vin(R_1C_y)+0.0677*Vin(R_1C_{y+1})+0.0228*Vin(R_2C_{y-1})+0.2193*Vin(R_2C_y)+0.0565*Vin(R_2C_{y+1});$$

a calculation formula for the grayscale value of $G_{1-5}$ is, $$Vout(R_xC_y)=0.0373*Vin(R_{x-1}C_{y-1})+0.3596*Vin(R_{x-1}C_y)+0.1110*Vin(R_{x-1}C_{y+1})+0.0400*Vin(R_xC_{y-1})+0.3596*Vin(R_xC_y)+0.0927*Vin(R_xC_y+1);$$

a calculation formula for the grayscale value of $G_{1-6}$ is, $$Vout(R_1C_y)=0.0278*Vin(R_1C_{y-1})+0.6957*Vin(R_1C_y)+0.0260*Vin(R_2C_{y-1})+0.2505*Vin(R_2C_y);$$

a calculation formula for the grayscale value of $G_{1-7}$ is, $$Vout(R_xC_y)=0.0260*Vin(R_{x-1}C_{y-1})+0.2505*Vin(R_{x-1}C_y)+0.0278*Vin(R_xC_{y-1})+0.6957*Vin(R_xC_y);$$

a calculation formula for the grayscale value of $G_{1-8}$ is, $$Vout(R_xC_y)=0.0204*Vin(R_{x-1}C_{y-1})+0.1962*Vin(R_{x-1}C_y)+0.0218*Vin(R_xC_{y-1})+0.5451*Vin(R_xC_y)+0.0204*Vin(R_{x+1}C_{y-1})+0.1962*Vin(R_{x+1}C_y);$$

a calculation formula for the grayscale value of $G_{1-9}$ is, $$Vout(R_xC_y)=0.0175*Vin(R_{x-1}C_{y-1})+0.1689*Vin(R_{x-1}C_y)+0.0435*Vin(R_{x-1}C_{y+1})+0.0188*Vin(R_xC_{y-1})+0.4692*Vin(R_xC_y)+0.0521*Vin(R_xC_{y+1})+0.0175*Vin(R_{x+1}C_{y-1})+0.1689*Vin(R_{x+1}C_y)+0.0435*Vin(R_{x+1}C_{y+1})$$

Figure 6:
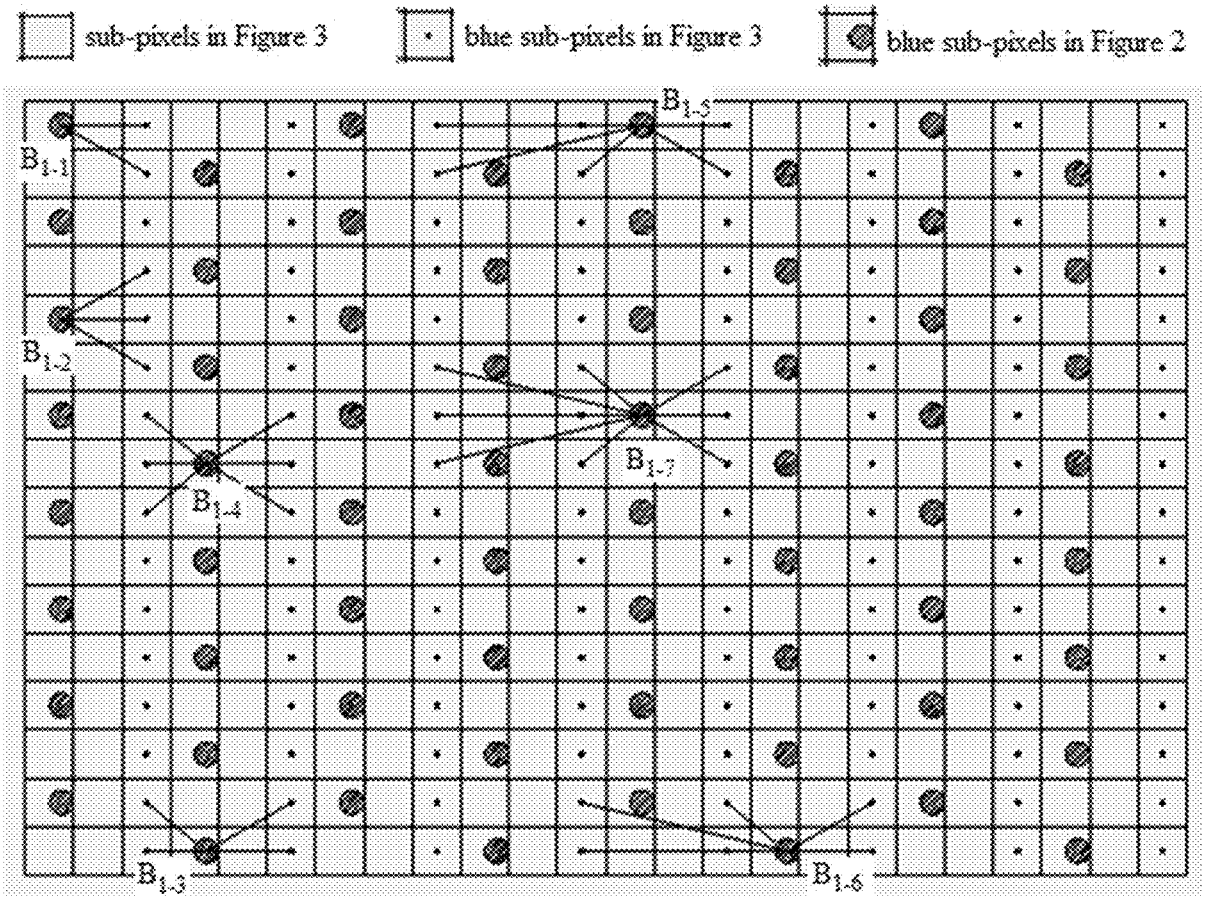
FIG. 6 is a diagram showing overlapping of central positions of blue sub-pixels in FIGS. 2 and 3.

Referebce is made to FIG. 6, which shows overlapping of central positions of blue sub-pixels in FIGS. 2 and 3. A distance from a blue sub-pixel in the first pixel array to a blue-pixel in the second pixel array located in a region of 3*3 or 1*3 around the blue sub-pixel in the first pixel array is measured. In a case of N=2, it may be obtained that $$coefficient_{R_xC_y}=(1/r_{R_xC_y}{}^2)/(\Sigma(1/r_{R_xC_y}{}^2).$$

Grayscale values of all blue sub-pixels in the first pixel array are calculated. It can be seen according to FIG. 6 that there are seven situations in total, namely, $B_{1-1}$, $B_{1-2}$, $B_{1-3}$, $B_{1-4}$, $B_{1-5}$, $B_{1-6}$ and $B_{1-7}$.

A calculation formula for the grayscale value of $B_{1-1}$ is, $$Vout(R_1C_1)=0.5702*Vin(R_1C_1)+0.4298*Vin(R_2C_1);$$

a calculation formula for the grayscale value of $B_{1-2}$ is, $$Vout(R_xC_1)=0.3006*Vin(R_{x-1}C_1)+0.3988*Vin(R_xC_1)+0.3006*Vin(R_{x+1}C_1);$$

a calculation formula for the grayscale value of $B_{1-3}$ is, $$Vout(R_xC_2)=0.2435*Vin(R_{x-1}C_1)+0.1536*Vin(R_{x-1}C_2)+0.3993*Vin(R_xC_1)+0.2037*Vin(R_xC_2);$$

a calculation formula for the grayscale value of $B_{1-4}$ is, $$Vout(R_xC_2)=0.1743*Vin(R_{x-1}C_1)+0.1099*Vin(R_{x-1}C_2)+0.2858*Vin(R_xC_1)+0.1458*Vin(R_xC_2)+0.1743*Vin(R_{x+1}C_1)+0.1099*Vin(R_{x+1}C_2);$$

a calculation formula for the grayscale value of $B_{1-5}$ is, $$Vout(R_1C_y)=0.0324*Vin(R_1C_{y-2})+0.3741*Vin(R_1C_{y-1})+0.1909*Vin(R_1C_y)+0.0307*Vin(R_2C_{y-2})+0.2281*Vin(R_2C_{y-1})+0.1439*Vin(R_2C_y);$$

a calculation formula for the grayscale value of $B_{1-6}$ is, $$Vout(R_xC_y)=0.0307*Vin(R_{x-1}C_{y-2})+0.2281*Vin(R_{x-1}C_{y-1})+0.1439*Vin(R_{x-1}C_y)+0.0324*Vin(R_xC_{y-2})+0.3741*Vin(R_xC_{y-1})+0.1909*Vin(R_xC_y);$$

and a calculation formula for the grayscale value of $B_{1-7}$ is, $$Vout(R_xC_y)=0.0219*Vin(R_{x-1}C_{y-2})+0.1626*Vin(R_{x-1}C_{y-1})+0.1026*Vin(R_{x-1}C_y)+0.0231*Vin(RxCy-2)+0.2667*Vin(RxCy-1)+0.1361*Vin(RxCy)+0.0219*Vin(R_{x-1}C_{y-2})+0.1626*Vin(R_{x+1}C_{y-1})+0.1026*Vin(R_{x+1}C_y);$$

Second Embodiment

A display device includes a first pixel array. The first pixel array includes multiple pixel groups arranged in a first direction, each of the pixel groups includes multiple pixels arranged in a second direction, and each of the pixels includes blue and red sub-pixels, or green and blue sub-pixels, or red and green sub-pixels, arranged in the second direction. Particularly, referring to FIG. 7, the first pixel array is Rainbow.

A second pixel array of the original image is acquired, in which each of the sub-pixels of the second pixel array has a grayscale value. Referring to FIG. 3, the second pixel array of the original image has a RGB stripe pixel arrangement.

Figure 7:
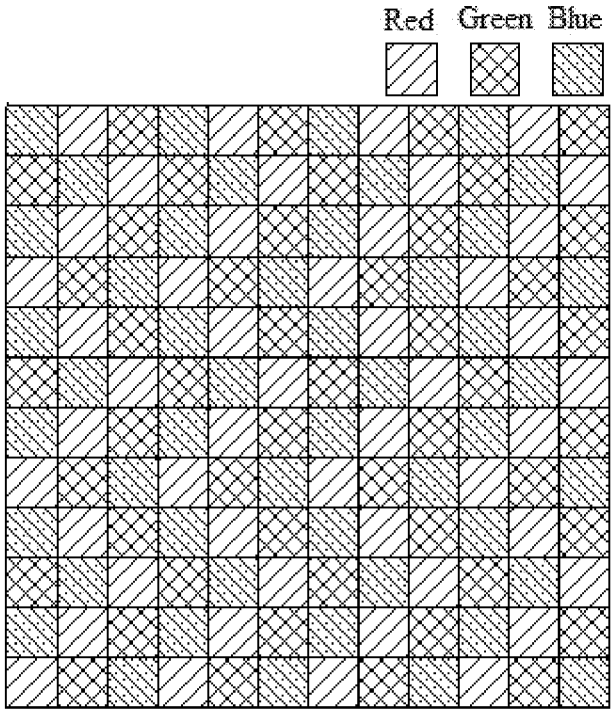
FIG. 7 is a schematic structural diagram of a first pixel array according to an embodiment of the present disclosure.
Figure 8:
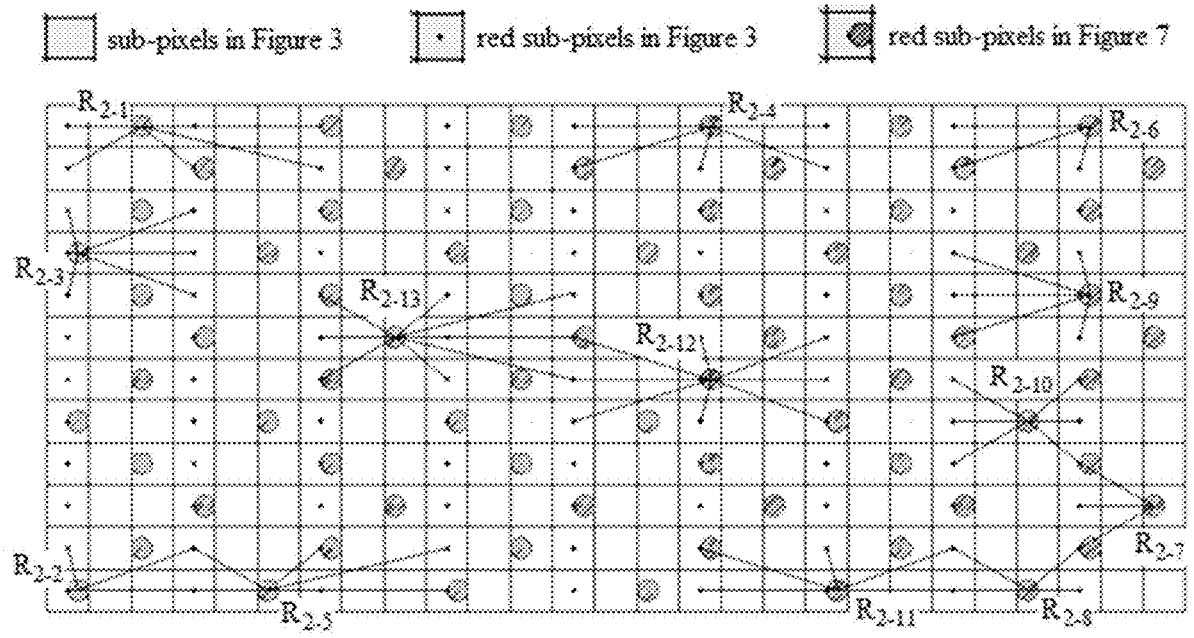
FIG. 8 is a diagram showing overlapping of central positions of red sub-pixels in FIGS. 7 and 3.

Reference is made to FIG. 8, which shows overlapping of central positions of red sub-pixels in FIGS. 7 and 3. A distance from a red sub-pixel in the first pixel array to a red sub-pixel in the second pixel array located in a region of 3*3 or 1*3 around the red sub-pixel in the first pixel array is measured. In a case of N=1.6, it may be obtained that $$coefficient_{R_xC_y}=(1/r_{R_xC_y}{}^{1.6})/(\Sigma(1/r_{R_xC_y}{}^{1.6}).$$

Grayscale values of all red sub-pixels in the first pixel array are calculated. It can be seen according to FIG. 8 that there are thirteen situations in total, namely, $R_{2-1}$, $R_{2-2}$, $R_{2-3}$, $R_{2-4}$, $R_{2-5}$, $R_{2-6}$, $R_{2-7}$, $R_{2-8}$, $R_{2-9}$, $R_{2-10}$, $R_{2-11}$, $R_{2-12}$ and $R_{2-13}$. For corresponding grascale value calculation formulars, one may refer to formulars the first embodiment, and the specific formulars are not described here.

Figure 9:
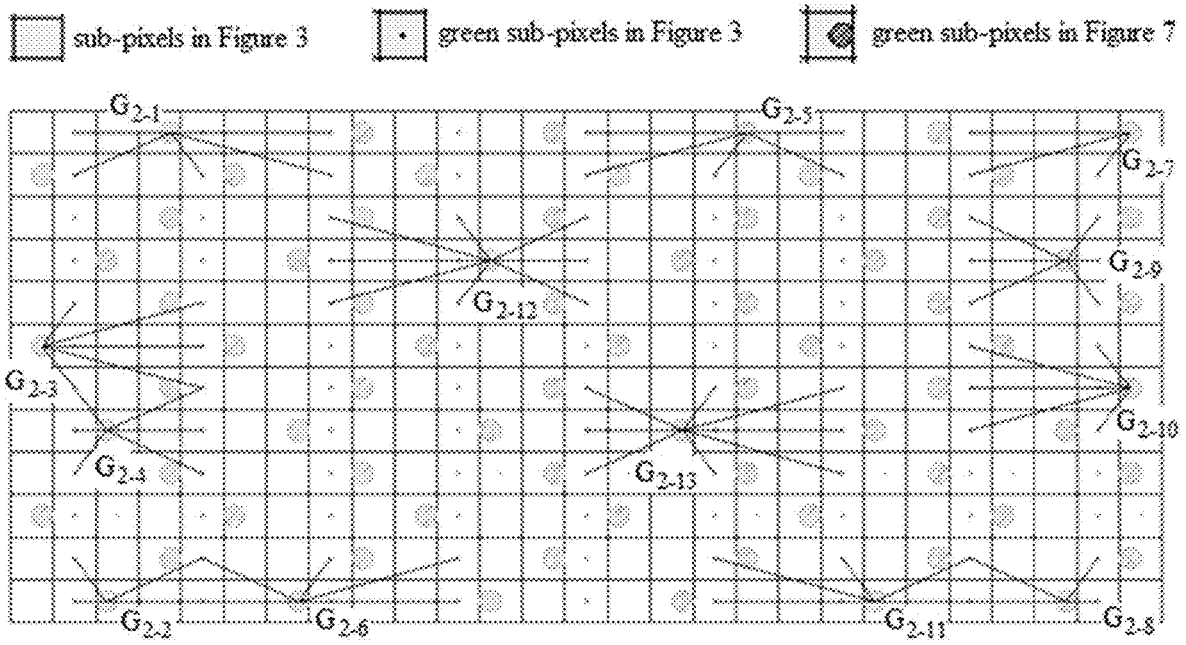
FIG. 9 is a diagram showing overlapping of central positions of green sub-pixels in FIGS. 7 and 3.

Reference is made to FIG. 9, which shows overlapping of central positions of green sub-pixels in FIGS. 7 and 3. A distance from a red sub-pixel in the first pixel array to a green sub-pixel in the second pixel array located in a region of 3*3 or 1*3 around the red sub-pixel in the first pixel array is measured. In a case of N=1.6, it may be obtained that $$coefficient_{R_xC_y}=(1/r_{R_xC_y}{}^{1.6})/(\Sigma(1/r_{R_xC_y}{}^{1.6}).$$

Grayscale values of all green sub-pixels in the first pixel array are calculated. It can be seen according to FIG. 9 that there are thirteen situations in total, namely, $G_{2-1}$, $G_{2-2}$, $G_{2-3}$, $G_{2-4}$, $G_{2-5}$, $G_{2-6}$, $G_{2-7}$, $G_{2-8}$, $G_{2-9}$, $G_{2-10}$, $G_{2-11}$, $G_{2-12}$ and $G_{2-13}$. For corresponding grascale value calculation formulars, one may refer to the formulars in the first embodiment, and the specific formulars are not described here.

Figure 10:
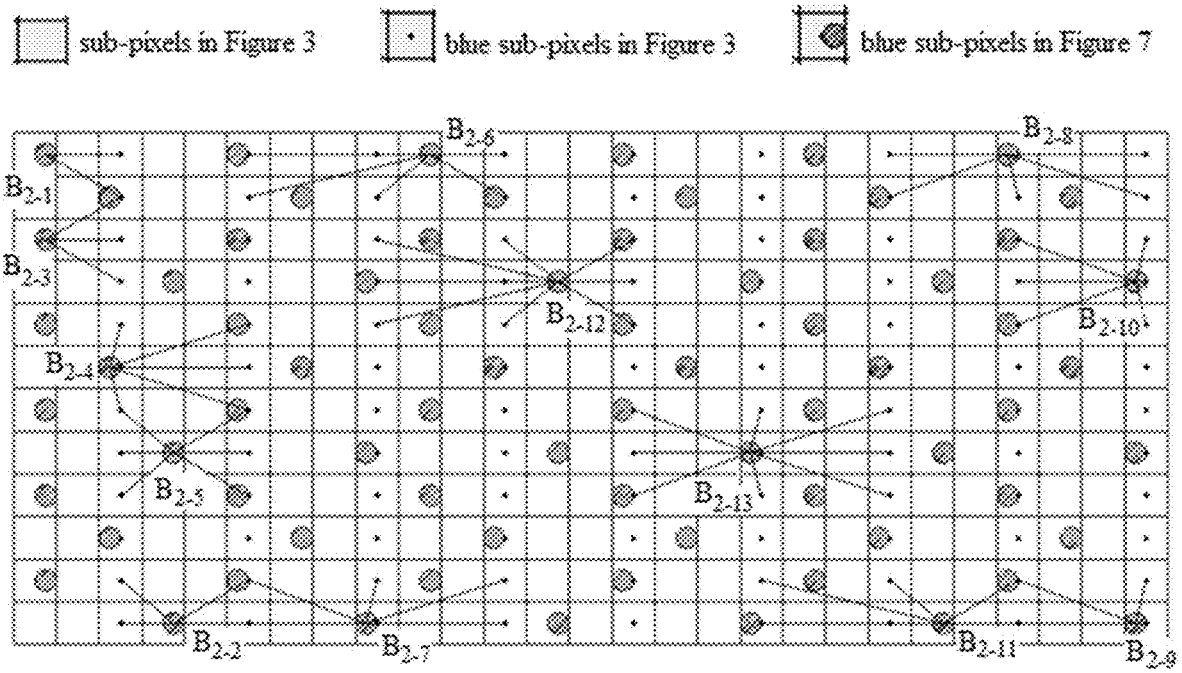
FIG. 10 is a diagram showing overlapping of central positions of blue sub-pixels in FIGS. 7 and 3.

Reference is made to FIG. 10, which shows overlapping of central positions of blue sub-pixels in FIGS. 7 and 3. A distance from a red sub-pixel in the first pixel array to a blue sub-pixel in the second pixel array located in a region of 3*3 or 1*3 around the red sub-pixel in the first pixel array is measured. In a case of N=1.6, it may be obtained that $$coefficient_{R_xC_y}=(1/r_{R_xC_y}{}^{1.6})/(\Sigma(1/r_{R_xC_y}{}^{1.6}).$$

Grayscale values of all blue sub-pixels in the first pixel array are calculated. It can be seen according to FIG. 9 that there are thirteen situations in total, namely, $B_{2-1}$, $B_{2-2}$, $B_{2-3}$, $B_{2-4}$, $B_{2-5}$, $B_{2-6}$, $B_{2-7}$, $B_{2-8}$, $B_{2-9}$, $B_{2-10}$, $B_{2-11}$, $B_{2-12}$ and $B_{2-13}$. For corresponding grascale value calculation formulars, one may refer to formulars in the first embodiment, and the specific formulars are not repeated here.

Third Embodiment

A display device includes a first pixel array. The first pixel array includes multiple pixel groups arranged in a first direction, each of the pixel groups includes multiple pixels arranged in a second direction, and each of the pixels includes blue and red sub-pixels, or green and blue sub-pixels, or red and green sub-pixels, arranged in the second direction. Particularly, referring to FIG. 11, the first pixel array is Delta.

A second pixel array of the original image is acquired. Each of the sub-pixels of the second pixel array has a grayscale value. Referring to FIG. 3, the second pixel array of the original image has a RGB stripe pixel arrangement.

Figure 11:
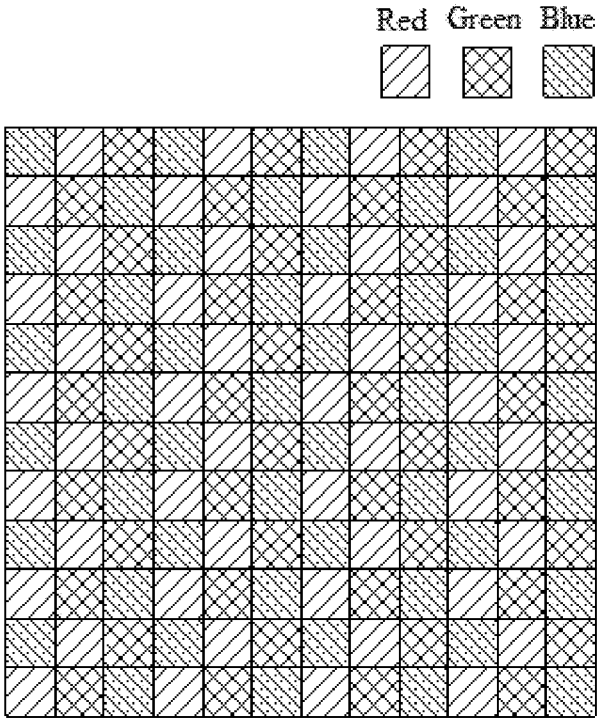
FIG. 11 is a schematic structural diagram of a first pixel array according to an embodiment of the present disclosure.
Figure 12:
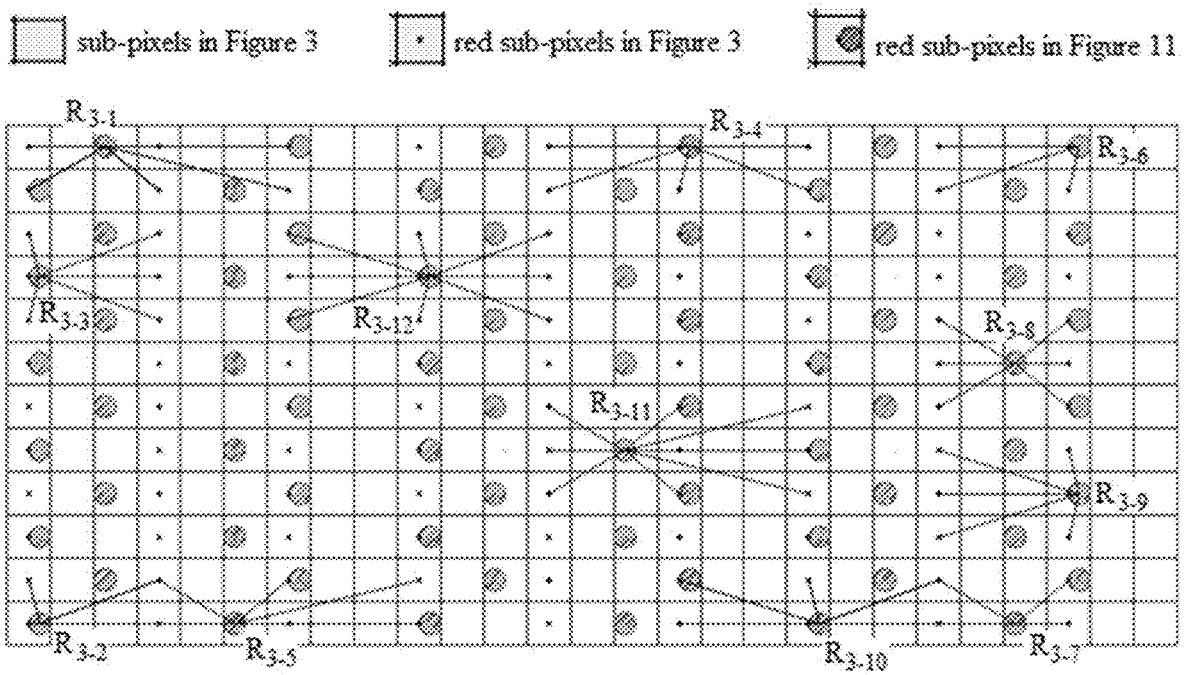
FIG. 12 is a diagram showing overlapping of central positions of red sub-pixels in FIGS. 11 and 3.

Reference is made to FIG. 12, which shows overlapping of central positions of red sub-pixels shown in FIGS. 11 and 3. A distance from a red sub-pixel in the first pixel array to a red sub-pixel in the second pixel array located in a region of 3*3 or 1*3 around the red sub-pixel in the first pixel array is measured. In a case of N=1.2, it may be obtained that $$\text{coefficient}_{R_xC_y}=(1/r_{R_xC_y}^{1.2})/(\Sigma(1/r_{R_xC_y}^{1.2}).$$

Grayscale values of all red sub-pixels in the first pixel array are calculated. It can be seen according to FIG. 8 that there are twelve situations in total, namely, $R_{3-1}$, $R_{3-2}$, $R_{3-3}$, $R_{3-4}$, $R_{3-5}$, $R_{3-6}$, $R_{3-7}$, $R_{3-8}$, $R_{3-9}$, $R_{3-10}$, $R_{3-11}$ and $R_{3-12}$. For corresponding grascale value calculation formulars, one may refer to the formulars in the first embodiment, and the specific formulars are not described here.

Figure 13:
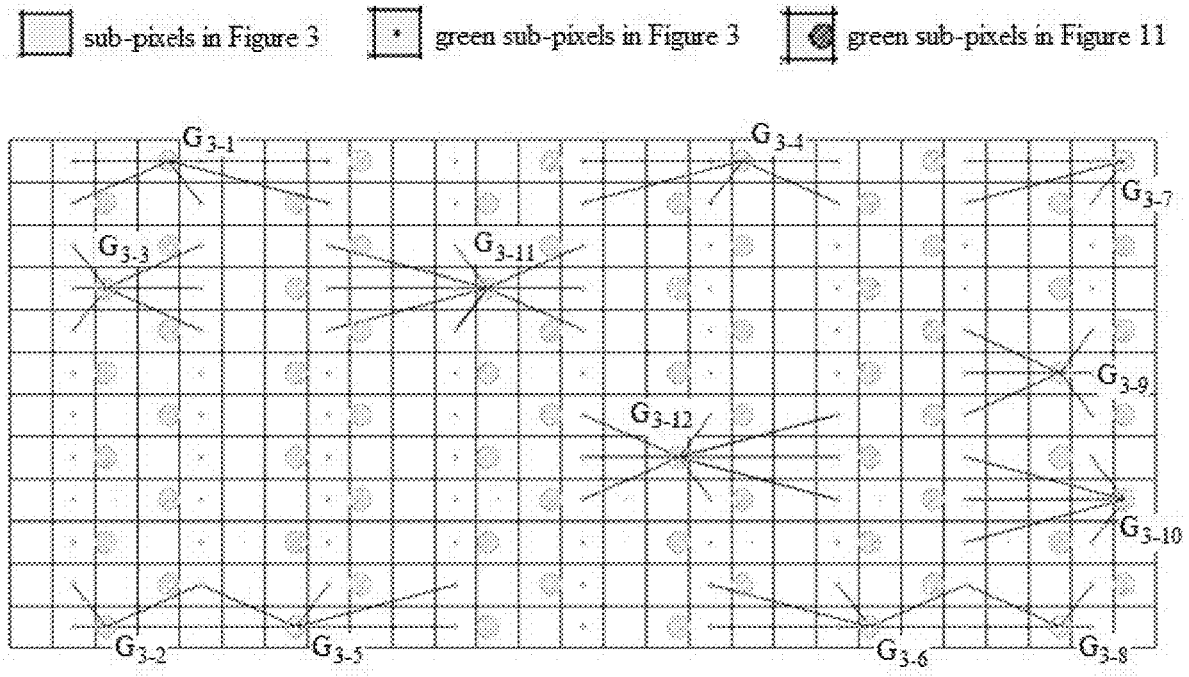
FIG. 13 is a diagram showing overlapping of central positions of green sub-pixels in FIGS. 11 and 3.

Reference is made to FIG. 13, which indicates overlapping of central positions of green sub-pixels in FIGS. 11 and 3. A distance from a red sub-pixel in the first pixel array to a green sub-pixel in the second pixel array located in a region of 3*3 or 1*3 around the red sub-pixel in the first pixel array is measured. In a case of N=1.2, it may be obtained that $$\text{coefficient}_{R_xC_y}=(1/r_{R_xC_y}^{1.2})/(\Sigma(1/r_{R_xC_y}^{1.2}).$$

Grayscale values of all green sub-pixels in the first pixel array are calculated. It can be seen according to FIG. 13 that there are twelve situations in total, namely, $G_{3-1}$, $G_{3-2}$, $G_{3-3}$, $G_{3-4}$, $G_{3-5}$, $G_{3-6}$, $G_{3-7}$, $G_{3-8}$, $G_{3-9}$, $G_{3-10}$, $G_{3-11}$ and $G_{3-12}$. For corresponding grascale value calculation formulars, one may refer to the formulars in the first embodiment, and the specific formulars are not described here.

Figure 14:
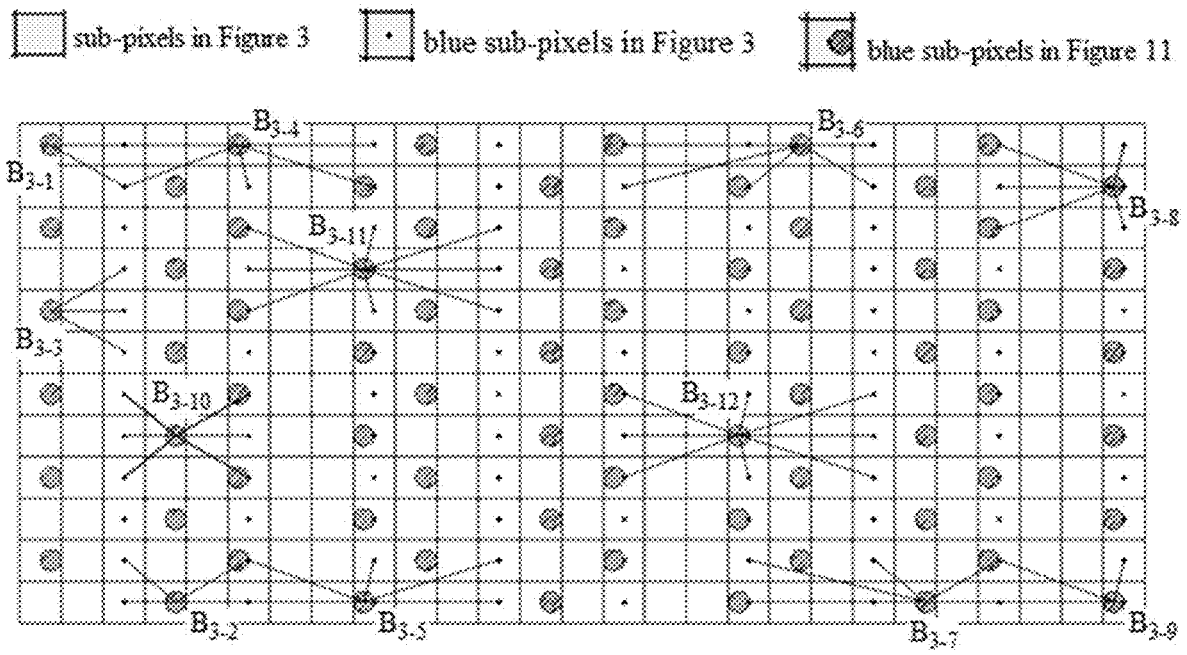
FIG. 14 is a diagram showing overlapping of central positions of blue sub-pixels in FIGS. 11 and 3.

Reference is made to FIG. 14, which shows overlapping of central positions of blue sub-pixels in FIGS. 11 and 3. A distance from a red sub-pixel in the first pixel array to a blue sub-pixel in the second pixel array located in a region of 3*3 or 1*3 around the red sub-pixel in the first pixel array is measured. In a case of N=1.2, it may be obtained that $$\text{coefficient}_{R_xC_y}=(1/r_{R_xC_y}^{1.2})/(\Sigma(1/r_{R_xC_y}^{1.2}).$$

Grayscale values of all blue sub-pixels in the first pixel array are calculated. It can be seen according to FIG. 9 that there are 12 situations in total, namely, $B_{3-1}$, $B_{3-2}$, $B_{3-3}$, $B_{3-4}$, $B_{3-5}$, $B_{3-6}$, $B_{3-7}$, $B_{3-8}$, $B_{3-9}$, $B_{3-10}$, $B_{3-11}$ and $B_{3-12}$. For corresponding grascale value calculation formulars, one may refer to the formulars in the first embodiment, and the specific formulars are not described here.

Figure 15:
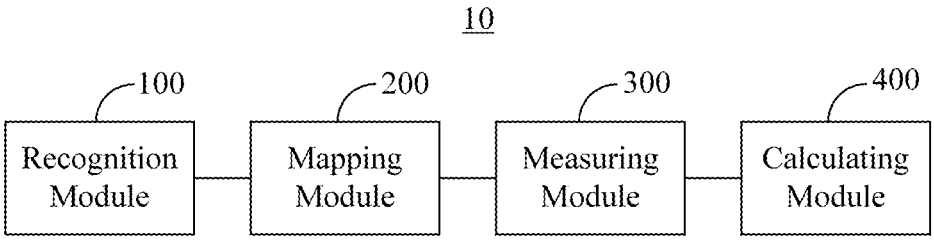
FIG. 15 is a schematic structural diagram of a rendering device according to an embodiment of the present disclosure.

In addition, a rendering device is further provided according to an embodiment of the present disclosure. Reference is made to FIG. 15, which is a schematic structural diagram of a rendering device according to an embodiment of the present disclosure.

A rendering device 10 for a display device is provided. The display device includes a first pixel array, the first pixel array includes multiple first pixels, and each of the first pixels includes multiple sub-pixels. The rendering device includes: a recognition module 100, a mapping module 200, a measuring module 300 and a calculating module 400.

The recognition module 100 is configured to acquire a second pixel array of an original image. Each of sub-pixels of the second pixel array has a grayscale value.

The mapping module 200 is configured to map the second pixel array of the original image onto the first pixel array.

The measuring module 300 is configured to search for central positions of the sub-pixels of the first pixel array and the second pixel array, determine a sub-pixel of the second pixel array which is located in a predetermined region of each sub-pixel in the first pixel array and has a same color as that of the sub-pixel in the first pixel array, and measure a distance from the determined sub-pixel to the central position of the sub-pixel in the first pixel array.

The calculating module 400 is configured to calculate, on the basis of the distance, a ratio of the sub-pixels of the second pixel array to the sub-pixels of the first pixel array, and calculate, on the basis of the grayscale value of the sub-pixels of the second pixel array and the ratio, grayscale values of all sub-pixels of the first pixel array.

With the rendering device mentioned above, the pixel array of the original image and the pixel array of the display device are processed, and contribution of all sub-pixels of the original image located in the predetermined region around sub-pixels in the display device to the sub-pixels in the display device is considered, to achieve a high-resolution display effect by a low-resolution display device.

It should be understood by those skilled in the art that all or a part of steps of the method described in the embodiments may be implemented by instructing relevant hardware through a program, and the program may be stored in a readable storage medium.

Technical features in embodiments mentioned above may be arbitrarily combined. For the conciseness of description, not all possible combinations of the technical features in the embodiments are described. However, combinations of the technical features should be regarded to fall in the scope of the present specification, as long as no contradictions exist in the combinations.

The embodiments above specifically describe multiple implementation methods of the present disclosure in detail, and the embodiments cannot be interpreted as a restriction on the scope of the present disclosure. It should be noted that for those skilled in the art, variations and improvements can be made to the present disclosure without departing from conception of the present disclosure, and the variations and improvements all fall in protection scope of the present disclosure. Therefore, the protection scope of the present disclosure is based on claims attached.

The invention claimed is:

1. A sub-pixel rendering method for a display device, wherein the display device comprises a first pixel array, the first pixel array comprises a plurality of first pixels and each of the first pixels comprises a plurality of sub-pixels, and the method comprises:

acquiring a second pixel array of an original image, wherein each of a plurality of sub-pixels of the second pixel array has a grayscale value;

mapping the second pixel array of the original image onto the first pixel array;

searching for central positions of the sub-pixels of the first pixel array and the second pixel array, determining a sub-pixel of the second pixel array which is located in a predetermined region of each sub-pixel in the first pixel array and has a same color as that of the sub-pixel in the first pixel array, and measuring a distance from the determined sub-pixel to the central position of the sub-pixel in the first pixel array;

calculating, on the basis of the distance, a ratio of the sub-pixels of the second pixel array to the sub-pixels of the first pixel array, and calculating, on the basis of the grayscale values of the sub-pixels of the second pixel array and the ratio, grayscale values of all sub-pixels of the first pixel array, wherein the ratio of the sub-pixels of the second pixel array to the sub-pixels of the first pixel array is calculated according to an equation:

$$\text{coefficient}_{R_xC_y}=(1/r_{R_xC_y}^{N})/(\Sigma(1/r_{R_xC_y}^{N})$$

where $\text{coefficient}_{R_xC_y}$ represents a ratio of the sub-pixels of the second pixel array to the sub-pixels in the $x^{th}$ row and the $y^{th}$ column of the first pixel array;

$r_{R_xC_y}$ represents a distance from the sub-pixel in the second pixel array to the sub-pixel in the $x^{th}$ row and the $y^{th}$ column of the first pixel array; and N is a constant greater than 1.

2. The sub-pixel rendering method according to claim 1, wherein the predetermined region is a region of 3*3 or 1*3 arranged around each sub-pixel of the first pixel array.

3. The sub-pixel rendering method according to claim 1, where 1<N<3.

4. The sub-pixel rendering method according to claim 3, wherein a grayscale value of each sub-pixel in the first pixel array is calculated according to an equation:

$$Vout(R_xC_y)=\text{coefficient}_{Rx-1Cy-1}*Vin(R_{x-1}C_{y-1})+\text{coefficient}_{Rx-1Cy}*Vin(R_{x-1}C_y)+\text{coefficient}_{Rx-1Cy+1}*Vin(R_{x-1}C_{y+1})+\text{coefficient}_{RxCy-1}*Vin(R_xC_{y-1})+\text{coefficient}_{RxCy}*Vin(R_xC_y)+\text{coefficient}_{RxCy}+1*Vin(R_xC_{y+1})+\text{coefficient}_{Rx+1Cy-1}*Vin(_{Rx+1Cy-1})+\text{coefficient}_{Rx+1Cy}*Vin(R_{x+1}C_y)+\text{coefficient}_{Rx+1Cy+1}*Vin(R_{x+1}C_{y+1});$$

where Vout represents a grayscale value of a sub-pixel in the first pixel array;

Vin represents a grayscale value of a sub-pixel in the second pixel array;

coefficient represents a ratio;

r represents a distance from the central position of the sub-pixel of the first pixel array to the central position of the sub-pixel of the second pixel array;

$R_x$ represents the $x^{th}$ row; and $C_y$ represents the $y^{th}$ column.

5. The sub-pixel rendering method according to claim 1, wherein the first pixel array comprises pixel groups arranged in a first direction, each of the pixel groups comprises a plurality of the pixels arranged in a second direction, and each of the pixels comprises red sub-pixels and green sub-pixels, or green sub-pixels and red sub-pixels, or blue sub-pixels and green sub-pixels, or green sub-pixels or blue sub-pixels, or red sub-pixels and blue sub-pixels, or blue sub-pixels and red sub-pixels, arranged in the second direction.

6. The sub-pixel rendering method according to claim 5, wherein two adjacent sub-pixels arranged in the second direction in the first pixel array have different colors.

7. The sub-pixel rendering method according to claim 6, wherein the first direction is a vertical direction and the second direction is a horizontal direction.

8. A rendering device for a display device, wherein the display device comprises a first pixel array, the first pixel array comprises a plurality of first pixels, each of the first pixels comprises a plurality of sub-pixels, and the rendering device comprises:

a recognition module, configured to acquire a second pixel array of an original image, wherein each of a plurality of sub-pixels of the second pixel array has a grayscale value;

a mapping module, configured to map the second pixel array of the original image onto the first pixel array;

a measuring module, configured to search for central positions of the sub-pixels of the first pixel array and the second pixel array, determine a sub-pixel of the second pixel array which is located in a predetermined region of each sub-pixel in the first pixel array and has a same color as that of the sub-pixel in the first pixel array, and measure a distance from the determined sub-pixel to the central position of the sub-pixel in the first pixel array;

a calculator, configured to calculate, on the basis of the distance, a ratio of the sub-pixels of the second pixel array to the sub-pixels of the first pixel array, and calculate, on the basis of the grayscale values of the sub-pixels of the second pixel array and the ratio, greyscale values of all sub-pixels of the first pixel array, wherein the ratio of the sub-pixels of the second pixel array to the sub-pixels of the first pixel array is calculated according to an equation:

$$\text{coefficient}_{R_xC_y}=(1/r_{R_xC_y}^{N})/(\Sigma(1/r_{R_xC_y}^{N})$$

where $\text{coefficient}_{R_xC_y}$ represents a ratio of the sub-pixels of the second pixel array to the sub-pixels in the $x^{th}$ row and the $y^{th}$ column of the first pixel array;

$r_{R_xC_y}$ represents a distance from the sub-pixel in the second pixel array to the sub-pixel in the $x^{th}$ row and the $y^{th}$ column of the first pixel array; and N is a constant greater than 1.

9. The rendering device according to claim 8, wherein the predetermined region is a region of 3*3 or 1*3 arranged around each sub-pixel of the first pixel array.

10. The rendering device according to claim 8, where 1<N<3.

11. The rendering device according to claim 10, wherein a grayscale value of each sub-pixel in the first pixel array is calculated according to an equation:

$$Vout(R_xC_y)=\text{coefficient}_{Rx-1Cy-1}*Vin(R_{x-1}C_{y-1})+\text{coefficient}_{Rx-1Cy}*Vin(R_{x-1}C_y)+\text{coefficient}_{Rx-1Cy+1}*Vin(R_{x-1}C_{y+1})+\text{coefficient}_{RxCy-1}*Vin(R_xC_{y-1})+\text{coefficient}_{RxCy}*Vin(R_xC_y)+\text{coefficient}_{RxCy}+1*Vin(R_xC_{y+1})+\text{coefficient}_{Rx+1Cy-1}*Vin(_{Rx+1Cy-1})+\text{coefficient}_{Rx+1Cy}*Vin(R_{x+1}C_y)+\text{coefficient}_{Rx+1Cy+1}*Vin(R_{x+1}C_{y+1});$$

where Vout represents a grayscale value of a sub-pixel in the first pixel array;

Vin represents a grayscale value of a sub-pixel in the second pixel array;

coefficient represents a ratio;

r represents a distance from the central position of the sub-pixel of the first pixel array to the central position of the sub-pixel of the second pixel array;

$R_x$ represents a row number; and $C_y$ represents a column number.

12. The rendering device according to claim 8, wherein the first pixel array comprises pixel groups arranged in a first direction, each of the pixel groups comprises a plurality of the pixels arranged in a second direction, and each of the pixels comprises red sub-pixels and green sub-pixels, or green sub-pixels and red sub-pixels, or blue sub-pixels and green sub-pixels, or green sub-pixels or blue sub-pixels, or red sub-pixels and blue sub-pixels, or blue sub-pixels and red sub-pixels, arranged in the second direction.

13. The rendering device according to claim 12, wherein two adjacent sub-pixels arranged in the second direction in the first pixel array have different colors.

14. The rendering device according to claim 13, wherein the first direction is a vertical direction and the second direction is a horizontal direction.

* * * * *